US011009189B2

(12) United States Patent
Green et al.

(10) Patent No.: US 11,009,189 B2
(45) Date of Patent: May 18, 2021

(54) MODULAR LIGHTING ASSEMBLY FOR RETROFITTING A LIGHT FIXTURE

(71) Applicant: ORION ENERGY SYSTEMS, INC., Manitowoc, WI (US)

(72) Inventors: Scott Green, Ponte Vedra Beach, FL (US); Matthew Tlachac, Manitowoc, WI (US); George Wilson, Middleburg, FL (US); Marc Meade, Manitowoc, WI (US); Daniel Fonseca, Manitowoc, WI (US); Ron Ogletree, Manitowoc, WI (US)

(73) Assignee: ORION ENERGY SYSTEMS, INC., Manitowoc, WI (US)

( * ) Notice: Subject to any disclaimer, the term of this patent is extended or adjusted under 35 U.S.C. 154(b) by 0 days.

(21) Appl. No.: 16/780,124

(22) Filed: Feb. 3, 2020

(65) Prior Publication Data

US 2020/0173610 A1 Jun. 4, 2020

Related U.S. Application Data

(63) Continuation of application No. 16/523,977, filed on Jul. 26, 2019, now Pat. No. 10,612,727.

(60) Provisional application No. 62/768,753, filed on Nov. 16, 2018.

(51) Int. Cl.

| | |
|---|---|
| ***F21K 9/275*** | (2016.01) |
| ***F21K 9/20*** | (2016.01) |
| ***F21K 9/66*** | (2016.01) |
| ***F21V 19/00*** | (2006.01) |
| ***F21V 23/04*** | (2006.01) |
| ***F21V 23/02*** | (2006.01) |
| ***F21V 17/10*** | (2006.01) |
| ***F21V 23/00*** | (2015.01) |
| *F21Y 103/10* | (2016.01) |
| *F21Y 115/10* | (2016.01) |

(52) U.S. Cl.

CPC ..... *F21K 9/20* (2016.08); *F21K 9/66* (2016.08); *F21V 17/10* (2013.01); *F21V 19/003* (2013.01); *F21V 23/003* (2013.01); *F21V 23/02* (2013.01); *F21V 23/0464* (2013.01); *F21V 23/0471* (2013.01); *F21Y 2103/10* (2016.08); *F21Y 2115/10* (2016.08)

(58) Field of Classification Search

CPC ..... F21V 21/35; F21V 21/34; F21K 9/275; F21K 9/27; F21Y 2103/10; F21Y 2105/10

See application file for complete search history.

(56) References Cited

U.S. PATENT DOCUMENTS 2,977,566 A * 3/1961 Neumann et al. ..... H01R 25/14 439/534
3,295,093 A * 12/1966 Neumann ..... H01R 25/14 439/118
3,529,274 A * 9/1970 Routh ..... F21V 21/35 439/118

(Continued)

*Primary Examiner* — Ismael Negron
(74) *Attorney, Agent, or Firm* — Foley & Lardner LLP

(57) ABSTRACT

A retrofit assembly includes a first lighting module, a second lighting module, and a hub positioned between the first lighting module and the second lighting module. When the first lighting module and second lighting module are at least partially received within cavities formed in the hub, longitudinal axes of the first lighting module and the second lighting module are aligned approximately parallel to one another.

20 Claims, 14 Drawing Sheets

(56) References Cited

U.S. PATENT DOCUMENTS

| | | | | |
|---|---|---|---|---|
| 4,688,154 | A * | 8/1987 | Nilssen | F21V 21/35 307/157 |
| 7,049,761 | B2 | 5/2006 | Timmermans et al. | |
| 8,348,492 | B2 * | 1/2013 | Mier-Langner | F21V 21/096 362/648 |
| 8,545,045 | B2 * | 10/2013 | Tress | F21V 21/005 362/217.17 |
| 8,668,361 | B2 | 3/2014 | Hasnain et al. | |
| 8,858,018 | B2 | 10/2014 | Verfuerth et al. | |
| 9,206,948 | B1 | 12/2015 | Scribante et al. | |
| 9,353,913 | B2 * | 5/2016 | Allen | F21V 23/0435 |
| 9,453,620 | B2 | 9/2016 | Green et al. | |
| 9,765,954 | B2 * | 9/2017 | Zaderej | F21V 23/00 |
| 9,927,073 | B2 | 3/2018 | May | |
| 9,927,081 | B2 * | 3/2018 | Bergman | F21V 29/70 |
| 10,228,097 | B2 | 3/2019 | Snijkers | |
| 10,281,119 | B2 * | 5/2019 | Ford | F21V 29/70 |
| 10,612,727 | B1 * | 4/2020 | Green | F21V 23/0471 |
| 2010/0027263 | A1 | 2/2010 | Wang | |
| 2010/0214747 | A1 * | 8/2010 | Jacobs | H05K 3/303 361/729 |
| 2010/0271804 | A1 * | 10/2010 | Levine | F21S 4/20 362/35 |
| 2014/0321109 | A1 | 10/2014 | Hwu et al. | |
| 2017/0108175 | A1 | 4/2017 | Ernst et al. | |
| 2017/0248279 | A1 | 8/2017 | Wu et al. | |
| 2018/0149319 | A1 | 5/2018 | Price | |
| 2018/0320885 | A1 | 11/2018 | Musser et al. | |

* cited by examiner

MODULAR LIGHTING ASSEMBLY FOR RETROFITTING A LIGHT FIXTURE

CROSS-REFERENCE TO RELATED APPLICATION

This application is a continuation of U.S. patent application Ser. No. 16/523,977, filed Jul. 26, 2019, which claims the benefit of and priority to U.S. Provisional Patent Application No. 62/768,753, filed Nov. 16, 2018, both of which are hereby incorporated by reference in their entireties.

BACKGROUND

Light fixtures, such as those for interior lighting applications, include light sources secured to enclosures. The light sources may contain various lighting elements (e.g., fluorescent elements, metal halide fixtures, etc.), which may be subject to failure during the useful life of the light fixture. More efficient lighting technologies may additionally or alternatively justify replacing an existing light source. However, the light sources are typically replaced by similar light sources (e.g., a failed fluorescent light fixture may be replaced by another fluorescent light fixture, etc.) because it is often difficult to retrofit an existing lighting fixture for operation with a different lighting technology. As a result, existing lighting fixtures are typically limited in their ability to utilize new, and more efficient, light sources.

SUMMARY

One exemplary embodiment relates to a retrofit assembly for a lighting fixture. The retrofit assembly includes a first lighting module, a second lighting module, and a hub positioned between the first lighting module and the second lighting module. The first lighting module includes a first tray and a first solid state light source. The first tray defines a first longitudinal axis and has a first seat and a first set of legs extending away from the first seat. The first solid state light source is coupled to the first seat. The second lighting module includes a second tray and a second solid state light source. The second tray defines a second longitudinal axis and has a second seat and a second set of legs extending away from the second seat. The second solid state light source is coupled to the second seat. The hub is defined by a base having a first end and a second end spaced apart from the first end. A first cavity is formed within the base inward from the first end, and receives a portion of the first lighting module. A second cavity is formed within the base inward from the second end, and receives a portion of the second lighting module. When the portion of the first lighting module is received within the first cavity and the portion of the second lighting module is received within the second cavity, the first longitudinal axis and the second longitudinal axis are arranged in an approximately parallel relationship.

Another exemplary embodiment relates to a retrofit assembly for a lighting fixture. The retrofit assembly includes a master lighting module, a slave lighting module, and a hub positioned between the master lighting module and the slave lighting module. The master lighting module includes a first tray, a power supply and controller coupled to the first tray, and a first solid state light source coupled to the first tray. The first tray defines a first longitudinal axis and has a first seat and a first set of legs extending away from the first seat. The first solid state light source is electrically coupled to the power supply and selectively actuated by the controller. The slave lighting module includes a second tray and a second solid state light source coupled to the second tray. The second tray defines a second longitudinal axis and has a second seat and a second set of legs extending away from the second seat. The second solid state light source is electrically coupled to the power supply and is selectively actuated by the controller. The hub is positioned between the first lighting module and the second lighting module to align the first longitudinal axis and the second longitudinal axis approximately parallel to one another.

Another exemplary embodiment relates to a retrofit assembly for a lighting fixture. The retrofit assembly includes a first lighting module, a second lighting module, and a hub. The first lighting module includes a first tray and a first solid state light source. The first tray has a first seat and a first set of legs extending away from the first seat to collectively define a first wire channel between the first seat and the lighting fixture. The first solid state light source is coupled to the first seat and is positioned outside the first wire channel. The second lighting module includes a second tray and a second solid state light source. The second tray has a second seat and a second set of legs extending away from the second seat to collectively define a second wire channel between the second seat and the lighting fixture. The second solid state light source is coupled to the second seat and is positioned outside the second wire channel. The hub has a base defining a first cavity and a second cavity on opposite sides of the base. The first cavity receives a portion of the first lighting module and the second cavity receives a portion of the second lighting module. A wire passage is formed within and through the base between the first cavity and the second cavity such that the first wire channel, the wire passage, and the second wire channel form a continuous wireway.

The invention is capable of other embodiments and of being carried out in various ways. Alternative exemplary embodiments relate to other features and combinations of features as may be recited herein.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring generally to the figures, a retrofit assembly facilitates retrofitting a light fixture or lighting fixture (e.g., troffer, recessed troffer, commercial light, LED fixture, recessed light, high bay fixture, wrap fixture, etc.) and replaces a preexisting lighting element with an LED board. A lens and lighting element of the preexisting lighting fixture may be removed. In some applications, a ballast, ballast plate, and light bulb sockets (e.g., tombstones, etc.) are simultaneously removed and disconnected from the preexisting lighting fixture and/or the input power. Next, the retrofit assembly is installed. The retrofit assembly includes two lighting modules and a central hub, according to an exemplary embodiment. The central hub may be interchangeable so as to allow two similarly-sized lighting modules to be used to retrofit existing light fixtures of various lengths (e.g., T5 and T8 fixtures). The central hub may be configured to engage with a housing of the existing light fixture. The lighting module may be coupled to the housing independent from the central hub. The retrofit assembly may include a mounting piece (e.g., clip, etc.) configured to engage with the lighting module and the housing so as to couple the lighting module to the housing. In some embodiments, the lighting module includes a seat configured to support a light source. The seat may include wings configured to block (e.g., occlude, cover, etc.) one or more slots or openings in the housing, and thereby prevent light from projecting through the housing to an upper wall or ceiling of a building.

Figure 1:
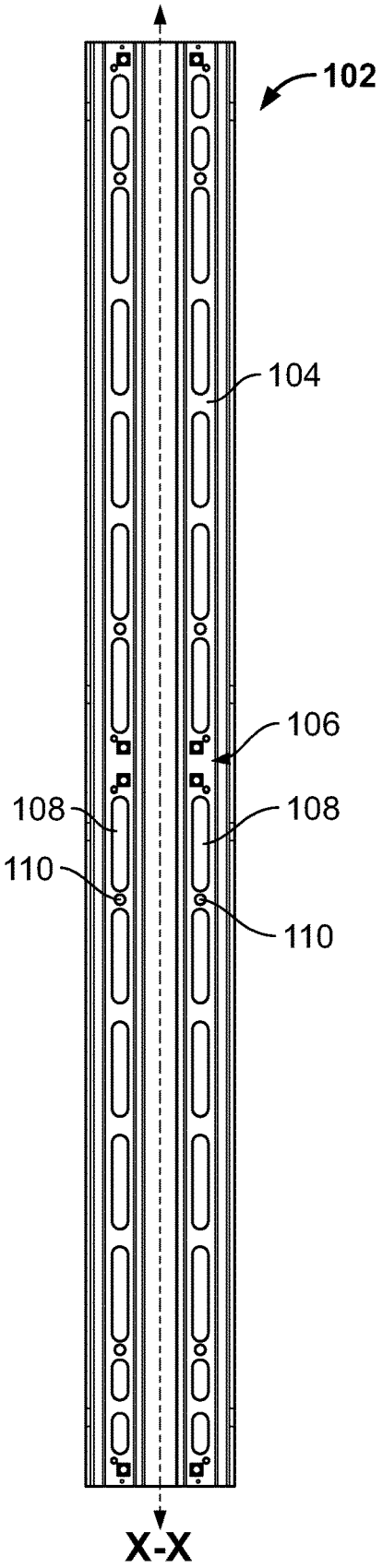
FIG. 1 is a bottom view of a prior art light fixture housing having a first length.
Figure 2:
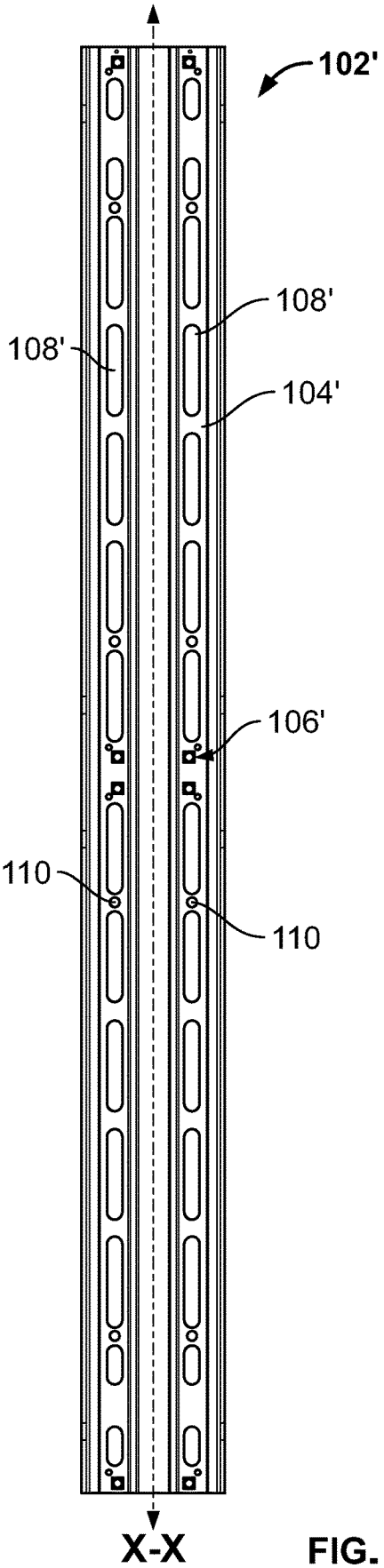
FIG. 2 is a bottom view of another prior art light fixture housing having a second length.
Figure 3A:
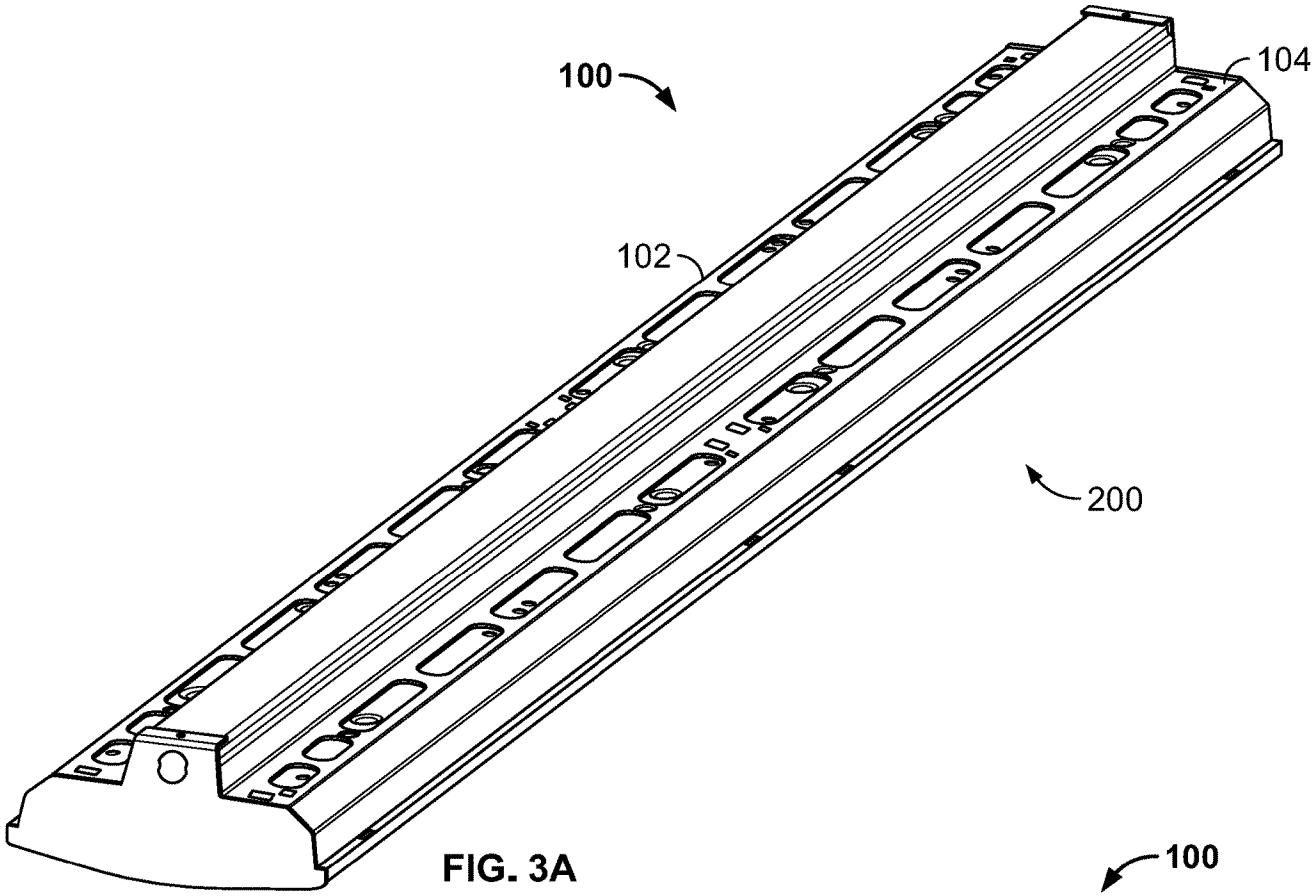
FIG. 3A is a perspective view of a lighting fixture incorporating a retrofit assembly, according to an exemplary embodiment.
Figure 3B:
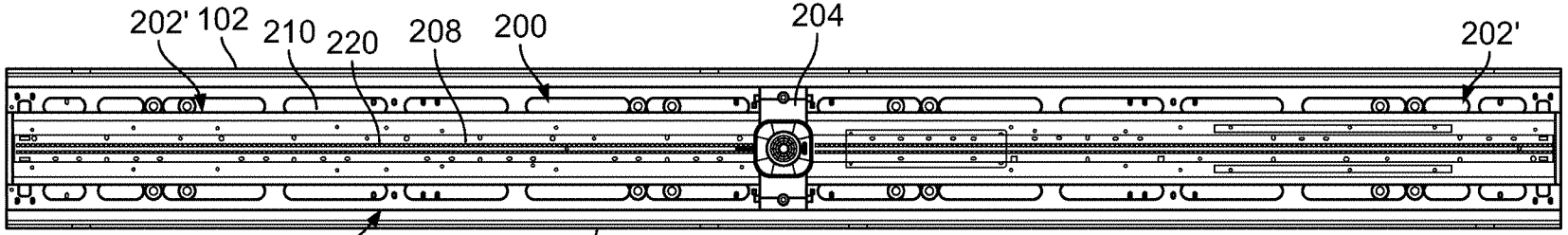
FIG. 3B is a bottom view of the lighting fixture of FIG. 3A.
Figure 3C:
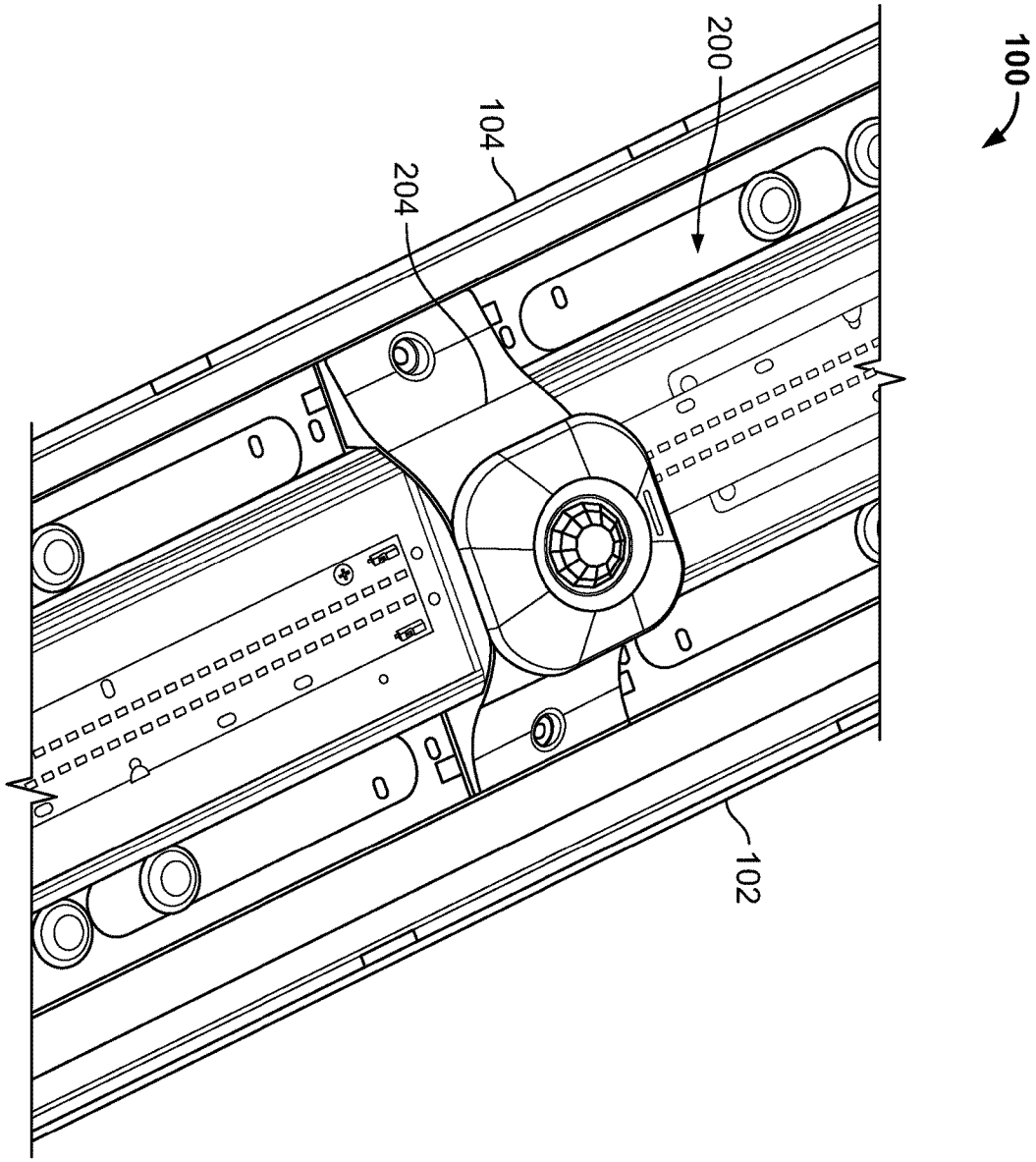
FIG. 3C is a detailed view of the lighting fixture of FIG. 3A, showing a central hub.
Figure 4A:
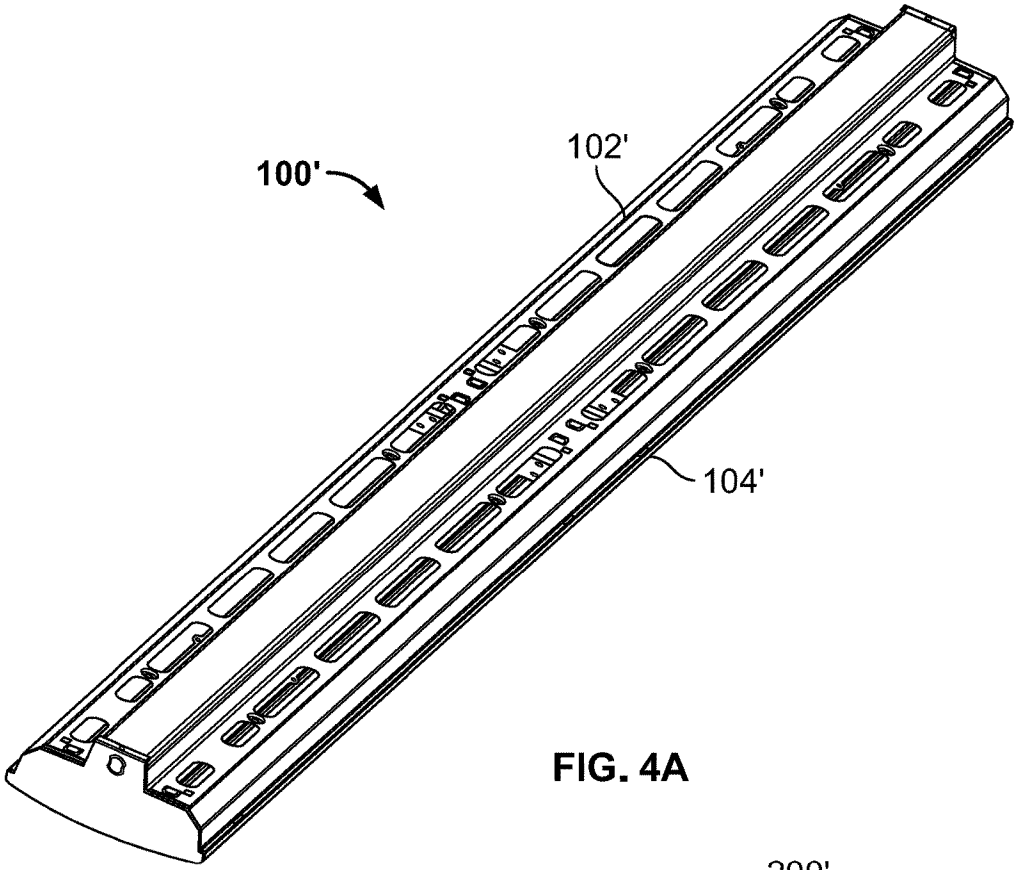
FIG. 4A is a perspective view of a lighting fixture incorporating a retrofit assembly, according to another exemplary embodiment.
Figure 4B:
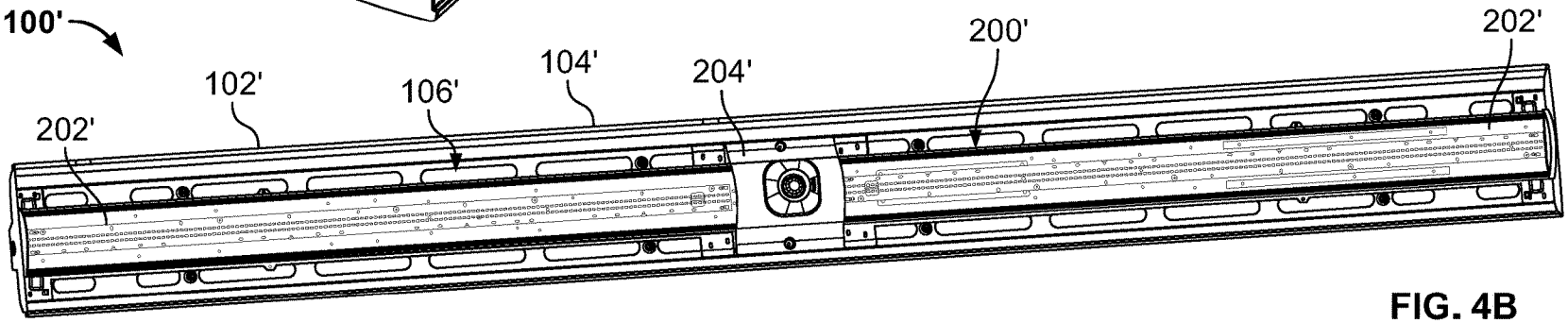
FIG. 4B is a bottom perspective view of the lighting fixture of FIG. 4A.
Figure 4C:
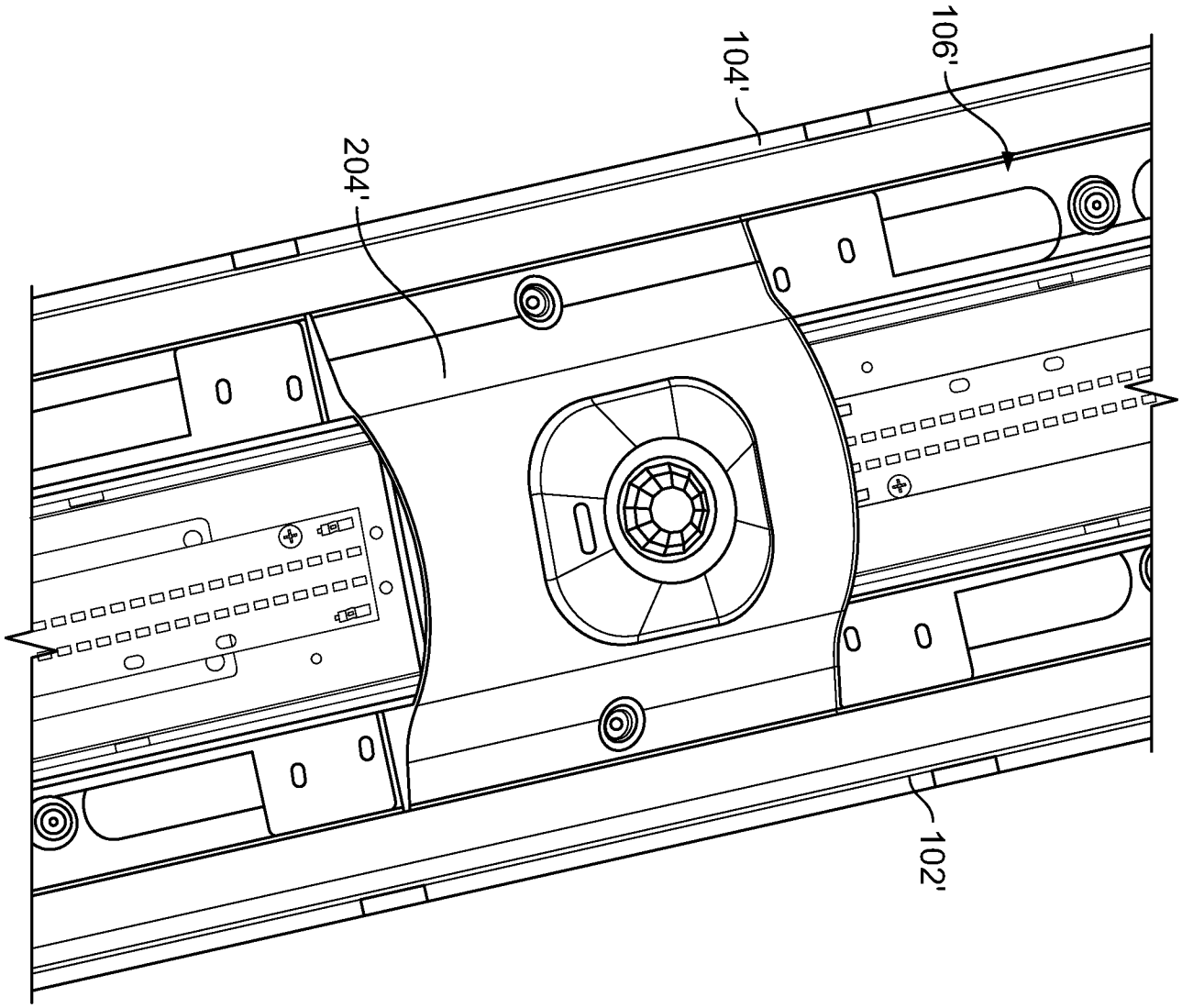
FIG. 4C is a detailed view of the lighting fixture of FIG. 4A, showing another central hub.
Figure 5B:
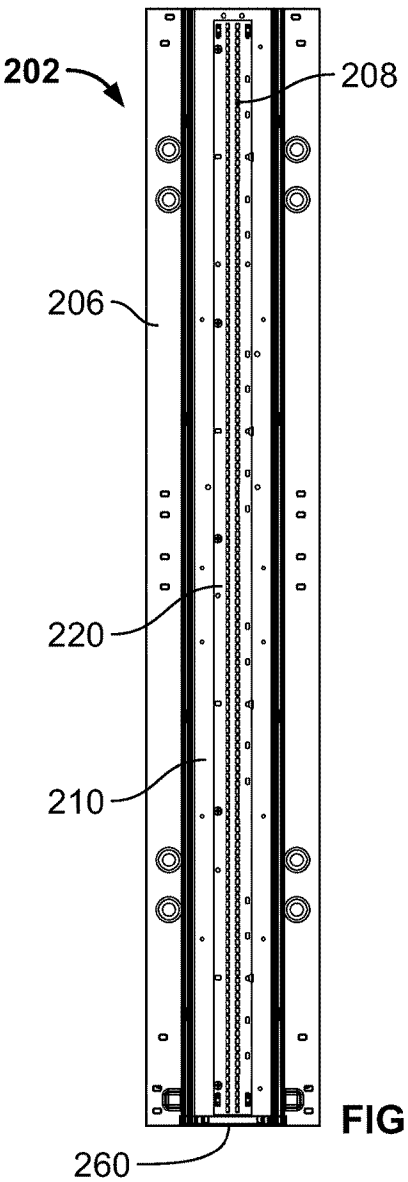
FIG. 5B is a bottom view of the lighting module of FIG. 5A.
Figure 5A:
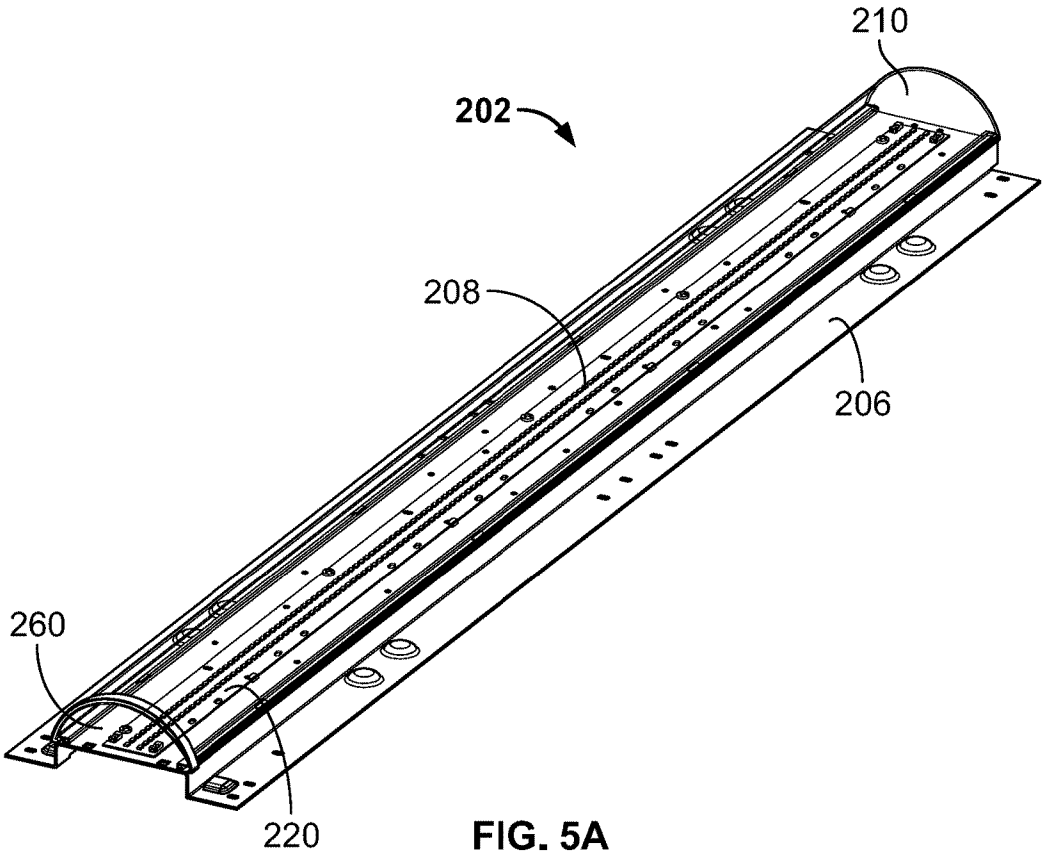
FIG. 5A is a detailed view of a lighting module present within the lighting fixtures of FIGS. 3A and 4A.

Referring to FIGS. 1-2, a housing 102, 102' (e.g., troffer, recessed troffer, commercial light, LED fixture, recessed light, high bay fixture, wrap fixture, etc.) includes a frame 104, 104' (e.g., body, enclosure, unit, hub, etc.) surrounding and defining a cavity 106, 106' having a variable depth. The housing 102, 102' is a housing of an existing lighting fixture (not shown) that can be retrofit (e.g., upgraded, etc.) with a new lighting element (e.g., lighting fixture, lamp, etc.) as described herein to arrive at light fixture 100, 100', shown in FIGS. 3A-4C. For example, the existing lighting fixture may be retrofit to effectively replace a previous lighting element (e.g., outdated lighting element, inefficient lighting element, damaged lighting element, etc.) with a new lighting element (e.g., high efficiency lighting element, light emitting diodes (LEDs), etc.). During the retrofitting process, the previous lighting element is removed from the existing lighting fixture. Removal may include removing a mounting component holding or supporting the previous lighting element to housing 102, 102'. As explained herein, light fixture 100, 100' is not specific to a specific housing 102, 102'. Instead, light fixture 100, 100' is configured to be implemented with a range of different housings 102, 102' such that various existing lighting fixtures can be retrofit to arrive at light fixture 100, 100'.

Several different housings 102, 102' for fluorescent light sources are used in buildings and other structures that may vary dimensionally. For example, T5 and T8 housings 102, 102' are both frequently used and installed within factories, warehouses, department stores, and the like to support differently-sized and differently-rated light sources. T5 and T8 housings 102, 102' may differ in width and, more significantly, length. In some fixtures, T5 housings 102 can be approximately 92 inches in length, while T8 housings 102' are approximately 96 inches in length, as measured along a longitudinal axis X-X.

Many buildings include both T5 and T8 housings, which are preferably retrofit to create stronger, more efficient solid state (e.g., light emitting diode (LED), organic light emitting diode (OLED), polymeric light emitting diode (PLED), quantum dot light emitting diode (QLED)) light fixtures 100, 100' shown in FIGS. 3A-4C. In order to accommodate differently-sized housings 102, 102', modular retrofit assemblies 200, 200' are installed within the cavity 106, 106' of the housing 102, 102'. The modular retrofit assemblies 200, 200' use several common components, so that a retrofit assembly 200 can quickly be modified into a retrofit assembly 200' to accommodate multiple types and sizes of housing 102, 102', as shown in FIGS. 11A-11D. The use of common components within the retrofit assemblies 200, 200' streamlines assembly, reduces inventory requirements, and improves the on-site assembly of light fixtures 100, 100'.

The retrofit assemblies 200, 200' used to create the solid state light fixtures 100, 100' can be formed of two light modules 202, 202' and a central hub 204, 204' positioned along the longitudinal axis X-X. The light modules 202, 202' can each be defined by the same length, while the central hubs 204, 204' can vary in thickness to adjust a total length of the retrofit assembly 200, 200'. For example, each light module 202, 202' can be defined by a length of approximately (i.e., within an inch) 45 inches, while the central hubs 204, 204' may vary in thickness between approximately 2 inches and about 6 inches, thereby varying a total length of the retrofit assemblies 200, 200' between approximately 92 inches and approximately 96 inches. The total length of the retrofit assemblies 200, 200' can be chosen to coincide with a length of the housing 102, 102' the retrofit assembly 200, 200' is intended to be installed into. For example, the retrofit assembly 200 can be approximately 92 inches long to accommodate a T5 fixture housing 102, while the retrofit assembly 200' can be approximately 96 inches long to accommodate a T8 fixture housing 102'. Additional differently-sized housings 102, 102' can be accommodated by making further alterations to the thickness or shape of the central hub 204, 204'.

As shown in FIGS. 5A-5B and 7A-7B, the light modules 202, 202' used to form the retrofit assemblies 200, 200' include a tray 206, 206', a solid state light source 208, 208', and a lens 210, 210'. The tray 206, 206' can be mounted to the frame 104, 104' of the housing 102, 102'. Fasteners, brackets, or other mounting equipment can be used to secure the tray 206, 206', and therefore, the light module 202, 202', within the cavity 106, 106' of the housing 102, 102'.

With additional reference to FIGS. 6A-6C and 8A-8C, the tray 206, 206' is shown with a variety of mounting and coupling features formed through different surfaces. The tray 206, 206' is formed of several segments that can be bent or otherwise formed into a continuous piece of sheet metal or other suitable material. The segments forming the tray 206, 206' generally include a planar seat 212 extending along a longitudinal axis Y-Y. A series of mounting holes 214 can be formed through the planar seat 212 to receive fasteners or other coupling devices, which can secure different items to the seat 212.

In some examples, a series of hooks 216, 218 extend away from the seat 212. The hooks 216, 218 can each include a generally vertical component 219 extending approximately orthogonally away from the seat 212 and a lateral component 221 extending away from the generally vertical component 219 toward the longitudinal axis Y-Y. The hooks 216, 218 can be spaced about the seat 212 to couple various items to the seat 212 as well. For example, each of the hooks 216 on one side of the seat 212 can be spaced apart from one another along the longitudinal axis Y-Y and positioned along a perimeter of the seat 212. The hooks 216 can be adapted to engage and secure the lens 210, 210' in a way that maintains the lens 210, 210' in a convex outer shape. To distribute the forces to the hooks 216 evenly, the hooks 216 can be arranged in opposing pairs along the longitudinal axis Y-Y. An inner set of hooks 218 can be formed between the pairs hooks 216, and can be used to couple a board 220, 220' supporting the solid state light sources 208, 208' onto the tray 206, 206'. The hooks 218 may be smaller than the hooks 216, and can be offset from each of the hooks 216 along the longitudinal axis Y-Y. In some embodiments, each of the hooks 216, 218 are formed integrally with the tray 206, 206'. Alternatively, the hooks 216, 218 can be coupled to the seat 212 using fasteners, brazing, or welding, for example.

A window 224 can be formed through the seat 212 to provide a path for wiring through the tray 206, 206' to the solid state light source 208, 208' and board 220, 220' coupled to the seat 212. Hangers 226 can be formed within or otherwise aligned with the window 224. The hangers 226 can provide generally planar surfaces 228 for supporting wiring that may extend along a portion of a length of the tray 206, 206'. The generally planar surfaces 228 of the hangers 226 can be parallel to and offset from the seat 212 to support or otherwise secure wires extending along a side of the seat 212 opposite the board 220, 220' and solid state light source 208, 208'. In some embodiments, the hangers 226 also protect the electrical connections made between wiring (not shown) and the board 220, 220' and solid state light sources 208, 208'.

A set of legs 230, 232 extend away from opposite sides of the seat 212 and define a channel 234 within the tray 206, 206'. The legs 230, 232 extend parallel to the longitudinal axis Y-Y, along an entire length of the tray 206, 206'. In some examples, the legs 230, 232 extend orthogonally away from the seat 212. A length of the legs 230, 232 defines a depth and capacity of the channel 234, and influences the type and size of electrical equipment that can be contained therein. For example, drivers 236, power sources 238, and/or controllers 240 (shown in FIGS. 11A-11D) may each be positioned within the channel 234 to operate or otherwise influence the solid state light sources 208, 208' positioned along the trays 206, 206'. The channel 234 can be sized so that all high voltage components are received therein, and are effectively walled off from access once the retrofit assemblies 200, 200' are installed.

Wings 242, 242', 244, 244' extend outwardly away from each leg 230, 232. The wings 242, 242', 244, 244' can extend orthogonally away from the legs 230, 232, within a plane parallel to the seat 212. The wings 242, 242', 244, 244' can extend along the entire length of the tray 206, 206', and may be approximately symmetrical with one another across the longitudinal axis Y-Y. In some embodiments, the shape of the wings 242, 244 is approximately constant along the entire length of the tray 206. The wings 242, 244 may be configured to at least partially cover (e.g., occlude, shield, etc.) openings or slots 108, 108' in the housing 102, 102'. The wings 242, 244 may help to reflect light away from an inner surface of the housing and may prevent light from being projected through the slots 108, 108' and onto an upper wall or ceiling of a building. In other embodiments, the shape of the wings 242', 244' varies along the length of the tray 206'. For example, the wings 242', 244' can include mounting tabs 246, 248 extending outwardly from each end of the tray 206', approximately perpendicular to the longitudinal axis Y-Y.

Figure 6B:
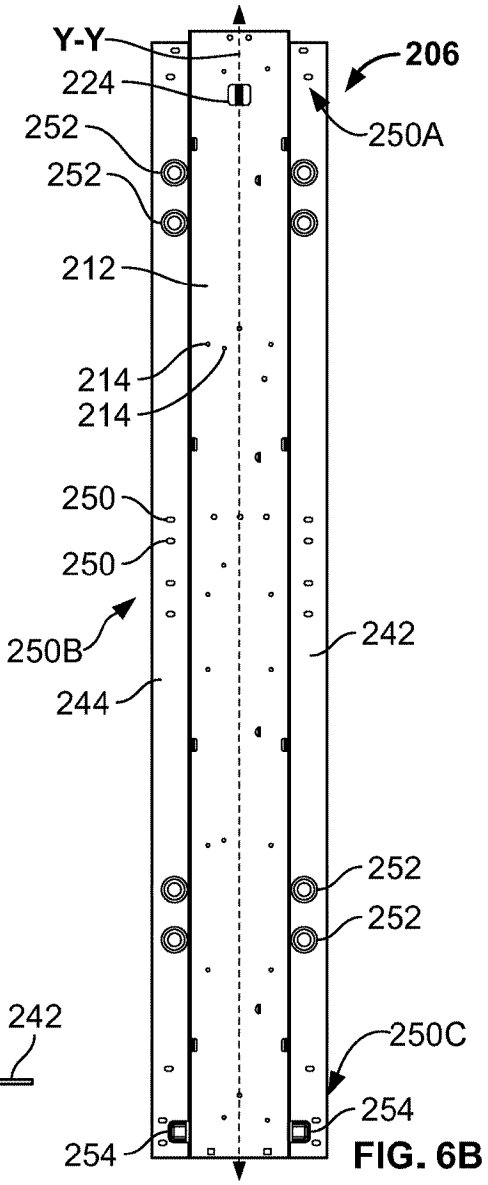
FIG. 6B is a bottom view of the tray of FIG. 6A.
Figure 6A:
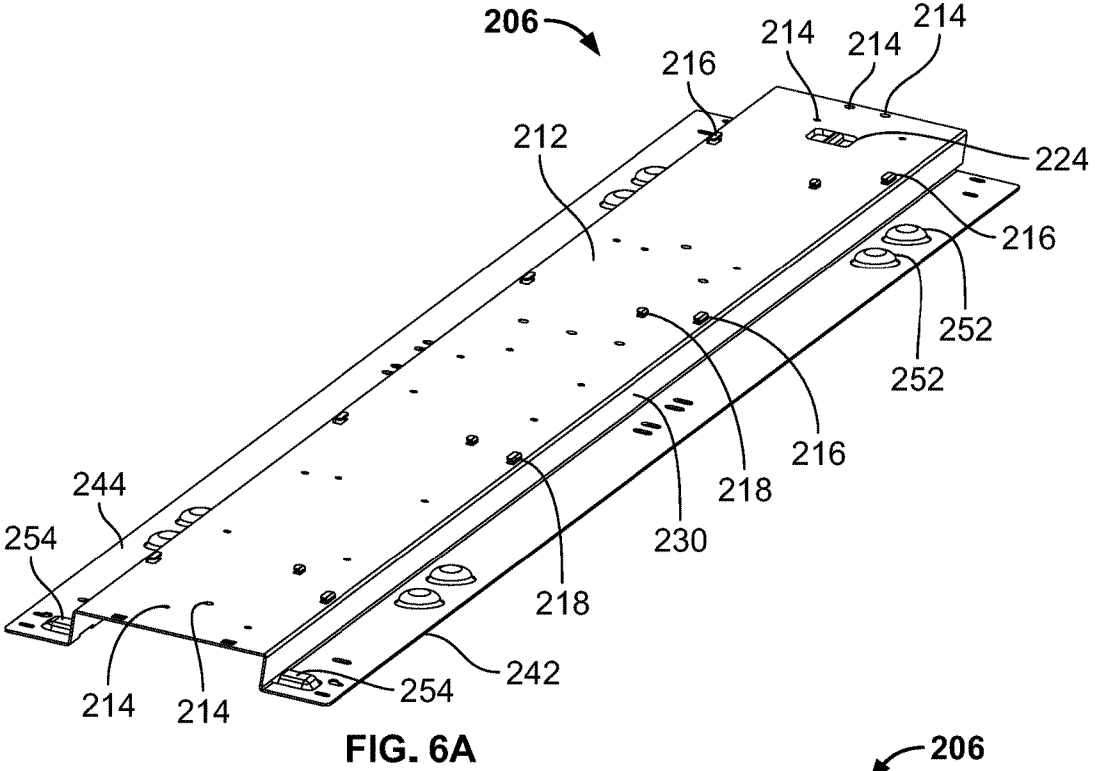
FIG. 6A is a bottom perspective view of a tray of the lighting module of FIG. 5A.
Figure 6C:
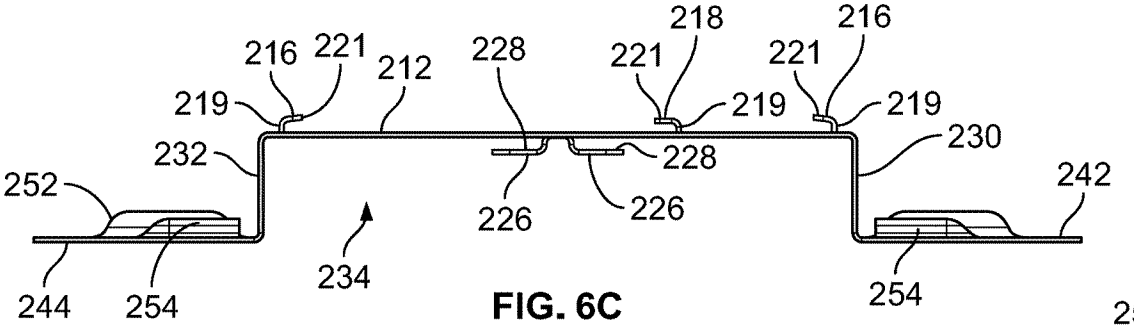
FIG. 6C is a front view of the tray of FIG. 6A.
Figure 7B:
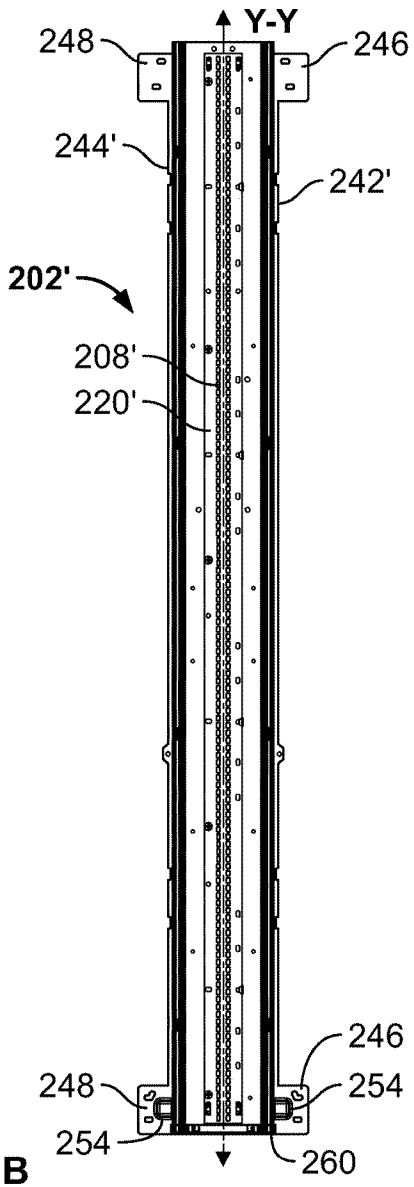
FIG. 7B is a bottom view of the lighting module of FIG. 7A.
Figure 7A:
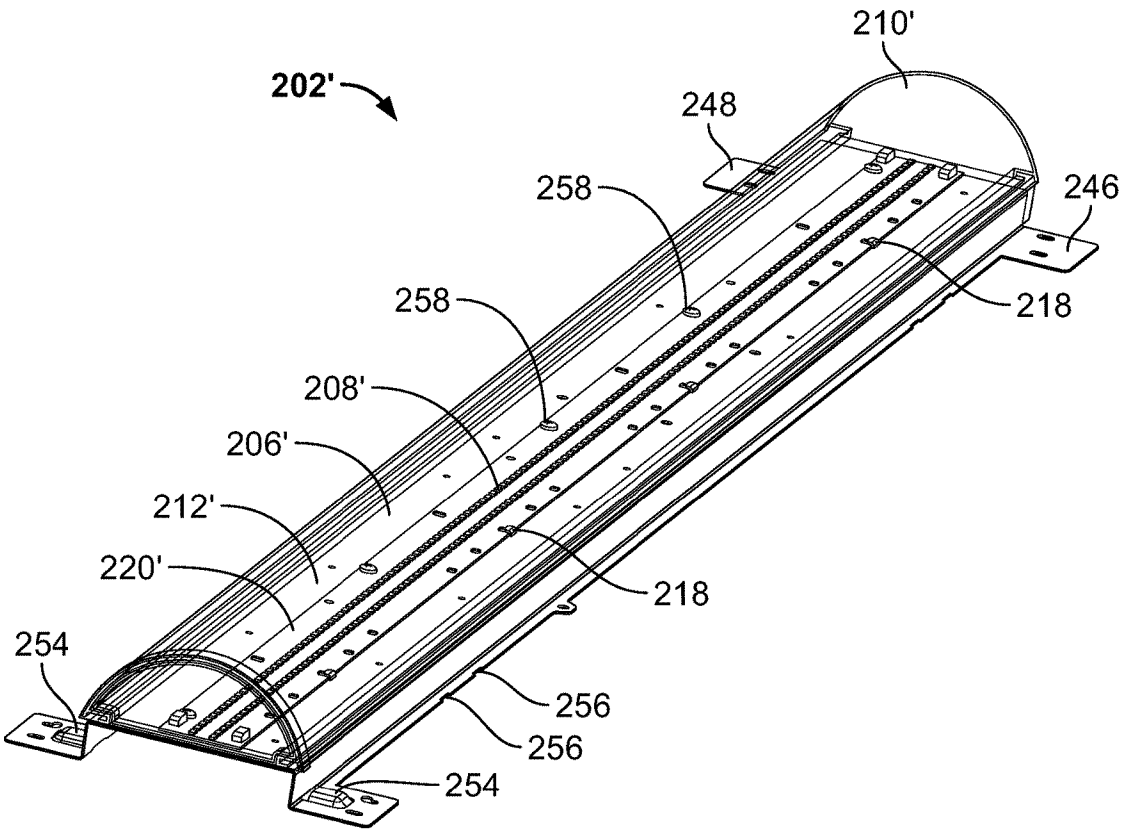
FIG. 7A is a bottom perspective view of another lighting module that can be incorporated into the lighting fixtures 3A and 4A.
Figure 8B:
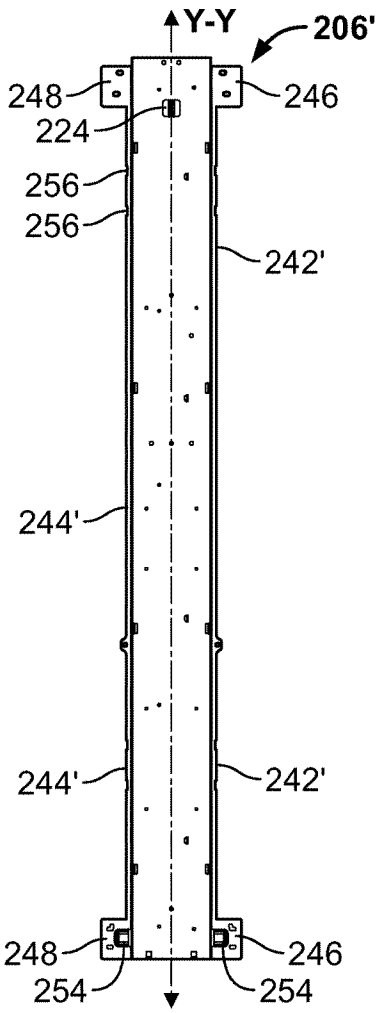
FIG. 8B is a bottom view of the tray of FIG. 8A.
Figure 8A:
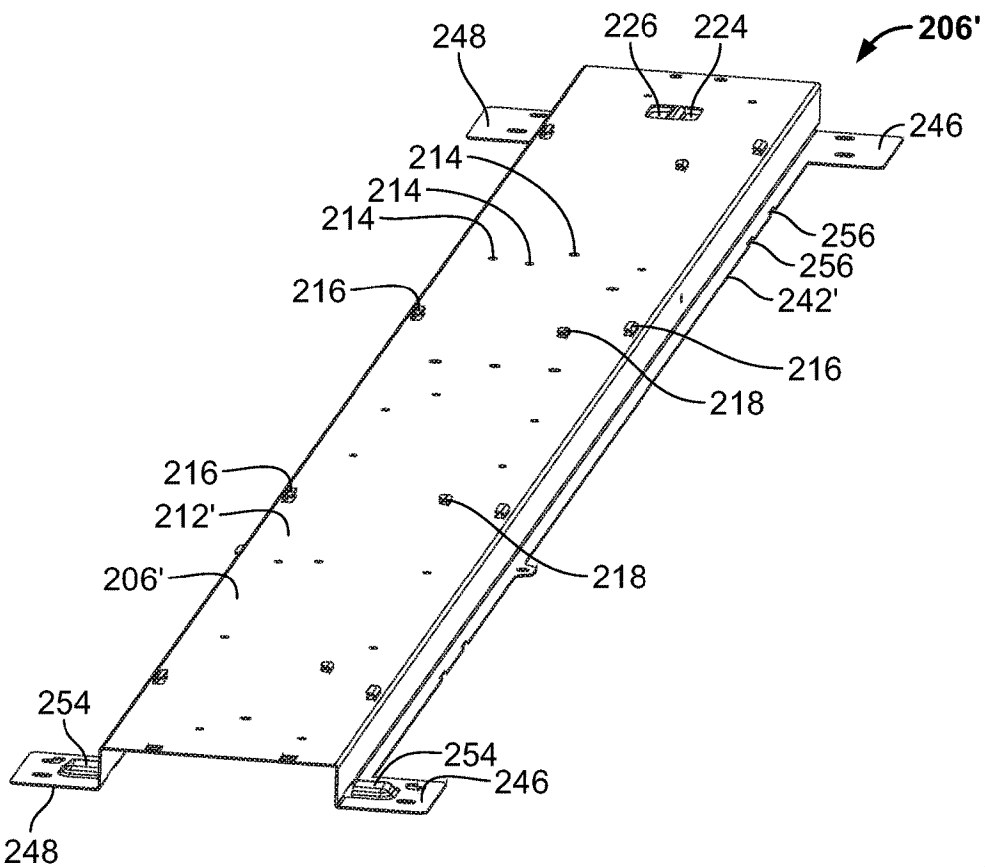
FIG. 8A is a bottom perspective view of a tray of the lighting module of FIG. 7A.
Figure 8C:
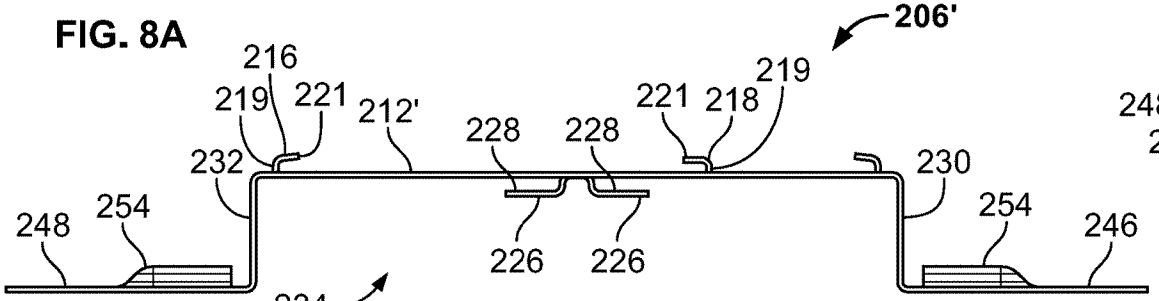
FIG. 8C is a front view of the tray of FIG. 8A.
Figure 9B:
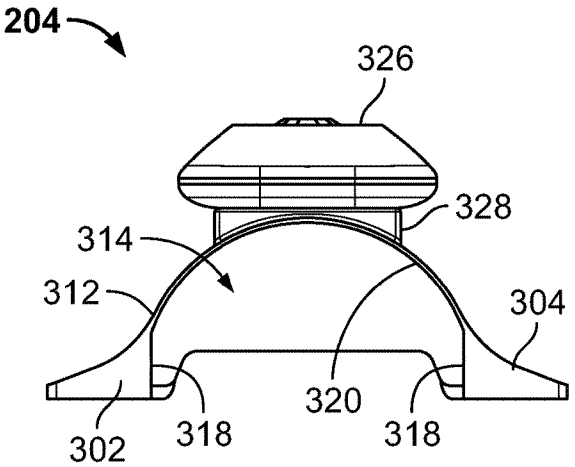
FIG. 9B is a front view of the central hub of FIG. 9A.
Figure 9D:
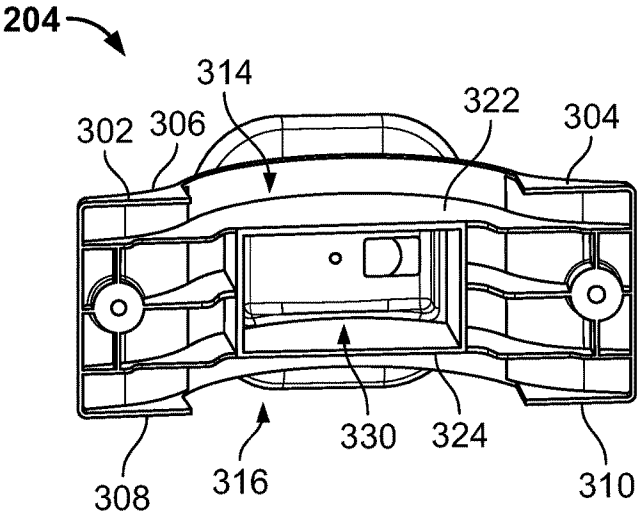
FIG. 9D is a top perspective view of the central hub of FIG. 9A.
Figure 9A:
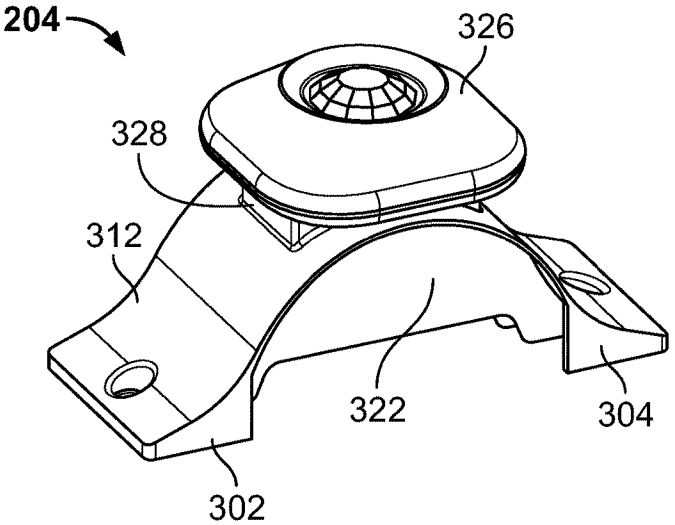
FIG. 9A is a bottom perspective view of the central hub of the lighting fixture of FIG. 3C, shown in isolation.
Figure 9C:
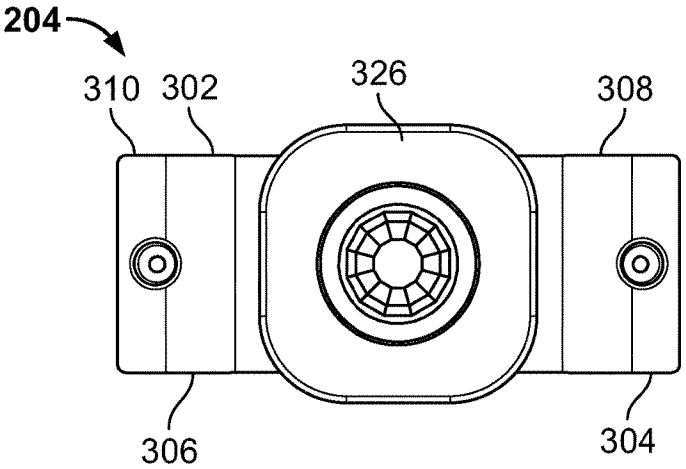
FIG. 9C is a bottom view of the central hub of FIG. 9A.
Figure 10B:
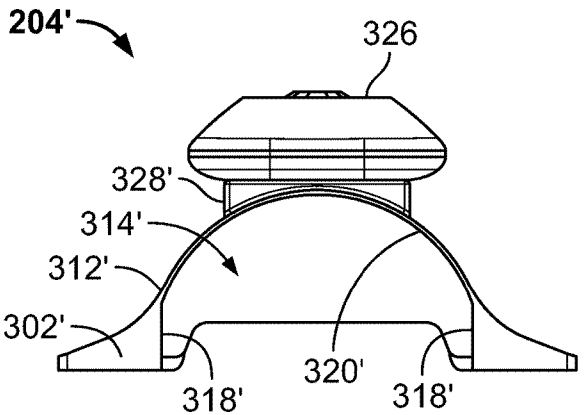
FIG. 10B is a front view of the central hub of FIG. 10A.
Figure 10D:
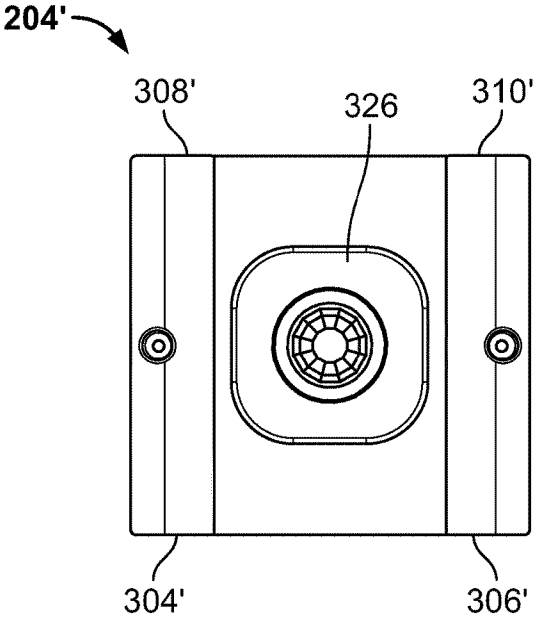
FIG. 10D is a bottom view of the central hub of FIG. 10A.
Figure 10A:
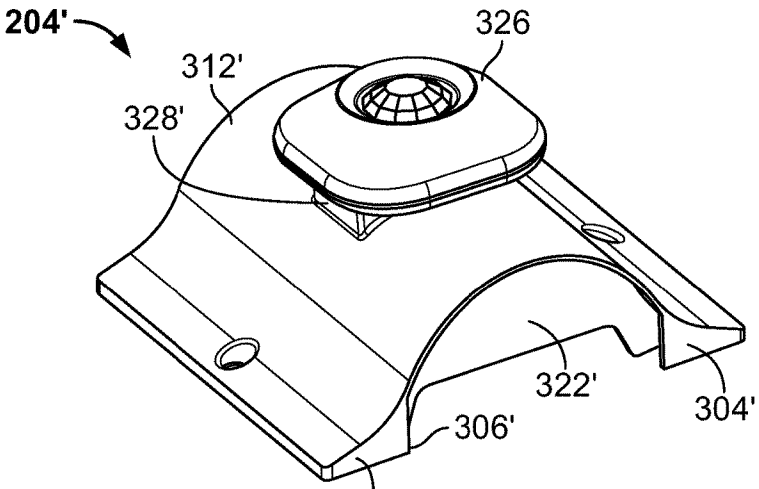
FIG. 10A is a bottom perspective view of the central hub of the lighting fixture of FIG. 4C, shown in isolation.
Figure 10C:
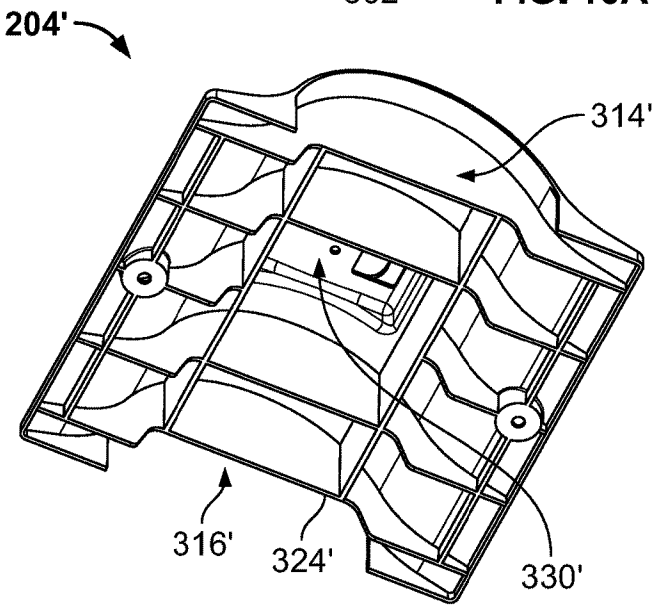
FIG. 10C is a top perspective view of the central hub of FIG. 10A.
Figure 11A:
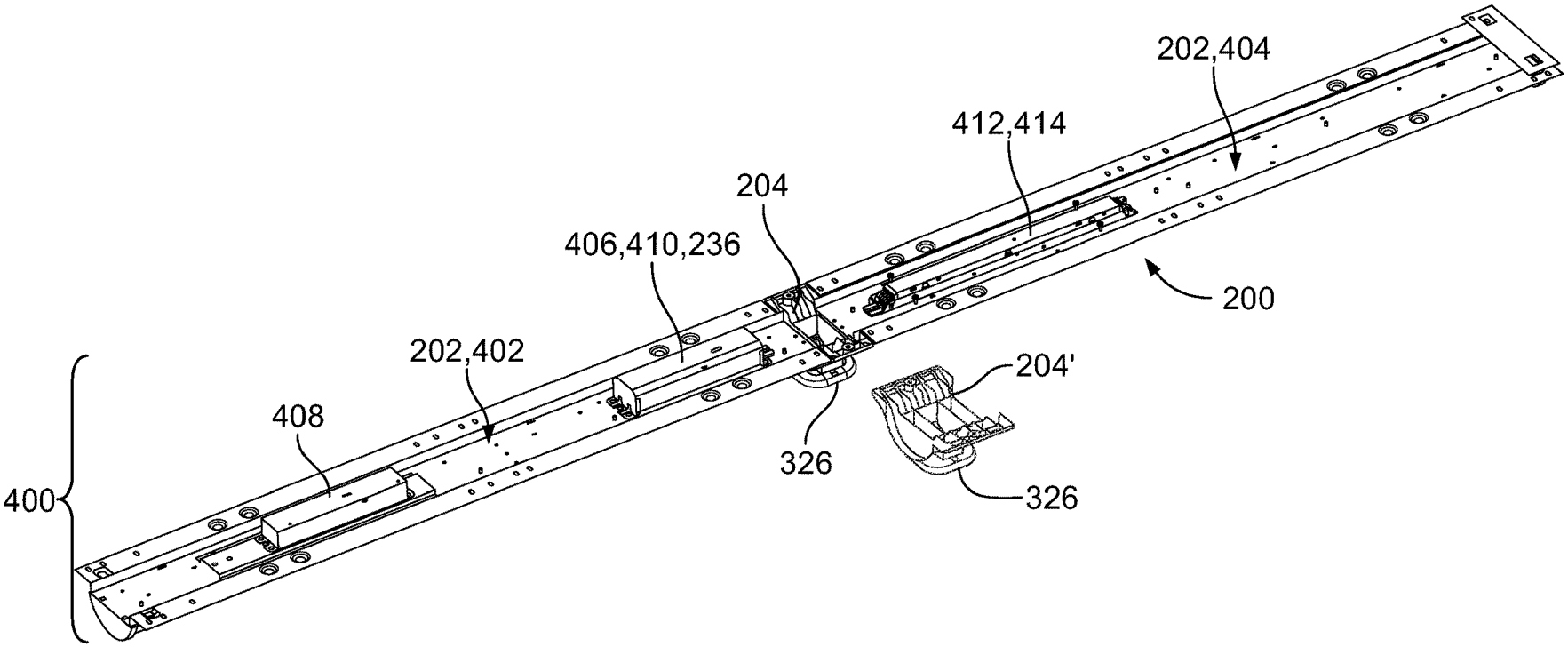
FIG. 11A is a top perspective view of a retrofit assembly that can be assembled using a retrofit assembly kit, according to an exemplary embodiment.
Figure 11B:
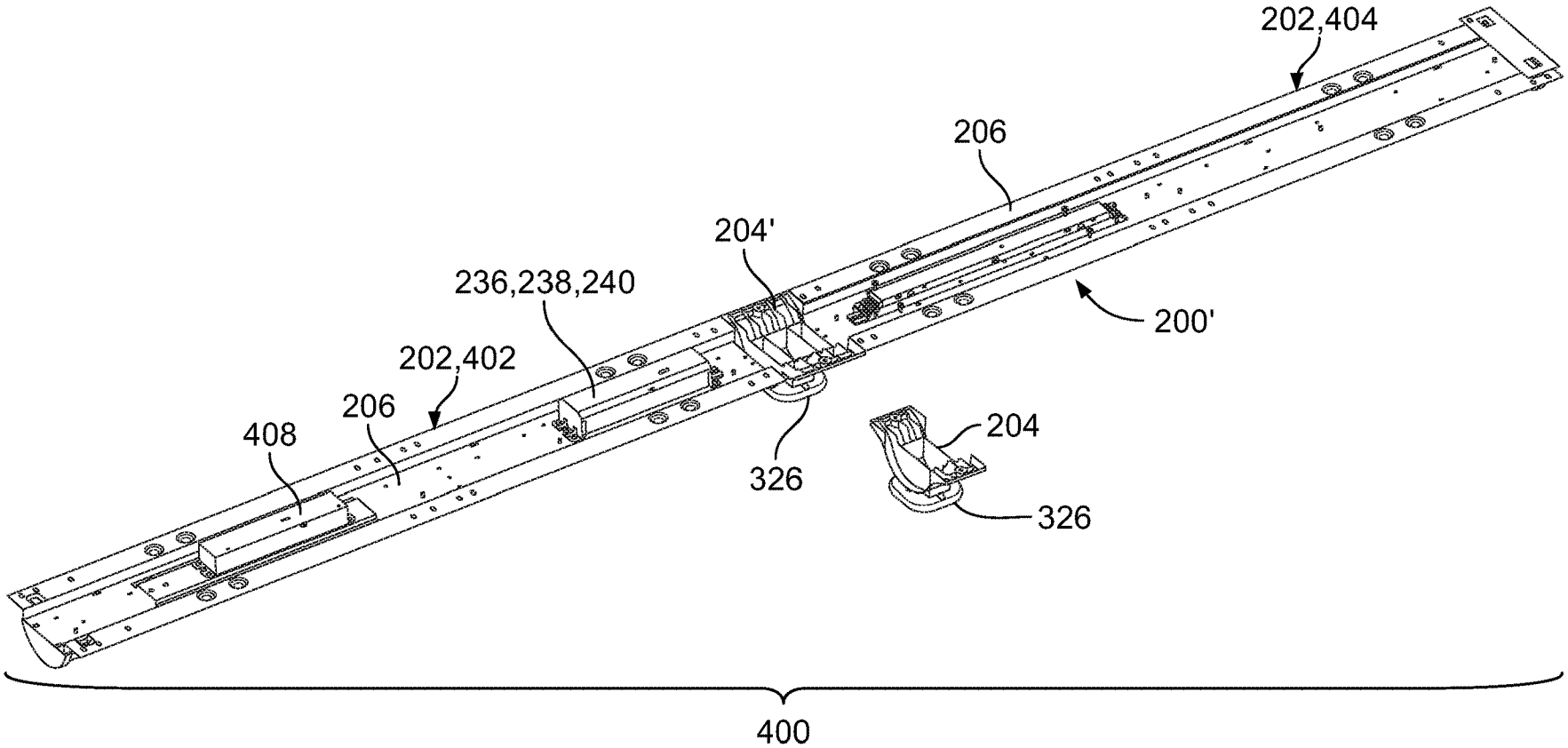
FIG. 11B is a top perspective view of another retrofit assembly that can be assembled using the retrofit assembly kit of FIG. 11A.
Figure 11C:
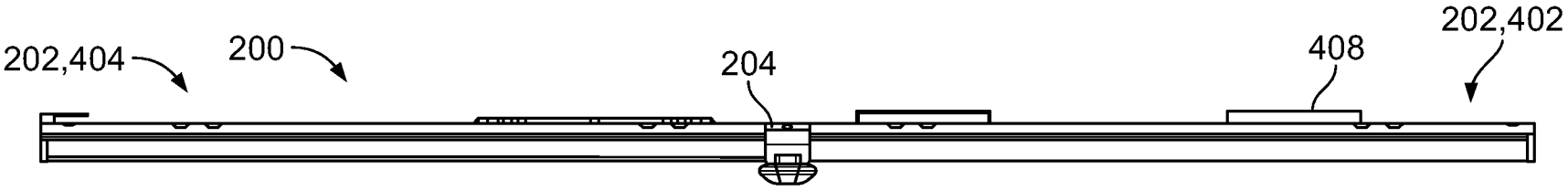
FIG. 11C is a side view of the retrofit assembly of FIG. 11A.
Figure 11D:
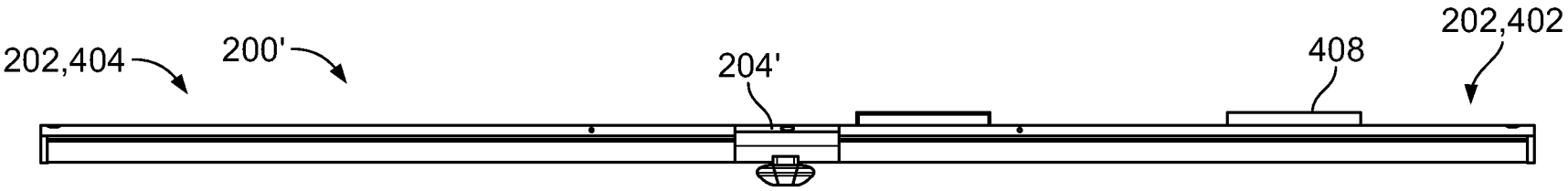
FIG. 11D is a side view of the retrofit assembly of FIG. 11B.

The wings 242, 242', 244, 244' each define and support a variety of different mounting and locating features that can aid the installation process. For example, a series of mounting holes 250 can be spaced along the wings 242, 242', 244, 244' to receive fasteners. The mounting holes 250 can be formed in distinct groups (e.g., first end groups 250A, central groups 250B, second end groups 250C) that may be positioned to align with housings 102, 102' of different shapes, sizes, or brands. For example, a first group of mounting holes 250A can be formed on an end (or both ends) of the tray 206, 206', while a second group of holes 250B are formed near a center of the tray 206, 206'. The first group of holes 250A are configured to align with recesses formed in housings 102 when installed, but are offset from recesses formed in housings 102' having a larger length than the housing 102. Similarly, the second group of holes 250B can be configured to align with recesses formed in housings 102' when installed, but are offset from recesses formed in housings 102. In some embodiments, each of the mounting holes 250 has an elongate, oval shape that accommodates and aligns with mounting holes formed in the housings 102, 102'. Similarly, locating features 252, 254 can be positioned along the wings 242, 242', 244, 244' at various locations about the longitudinal axis Y-Y. The locating features 252, 254 can be indents formed within the wings 242, 242', 244, 244', for example, which are shaped to be complimentary with protrusions 110, 110' within the frame 104, 104' of the housing 102, 102'. As depicted in FIGS. 6A-6C, four pairs of generally cylindrical indents 252 are formed within the wings 242, 244 to nest upon conical or hemispherical protrusions 110, 110' formed along the housing 102, 102'. When the protrusions 110, 110' are received within the indents 252, rotational and longitudinal movement of the tray 206, 206' relative to the housing 102, 102' is restricted, which can help to properly locate each light module 202, 202' within housing 102, 102' before the light modules 202, 202' are secured to the frame 104, 104' of the housing 102, 102' using fasteners or other coupling devices. Rectangular indents 254 can be formed within ends of the wings 242, 242', 244, 244' as well to mate with rectangular protrusions 112 formed along each end of the housing 102, 102'. Alternatively, the wings 242', 244' can include a series of notches 256 formed in the wings to receive and surround a portion of the protrusions 110, 110' to restrict lateral, longitudinal, and rotational motion of the tray 206, 206' relative to the housing 102, 102'. The mounting tabs 246, 248 can include a series of through holes that may align with holes formed through various different types and sizes of housings 102, 102'.

As shown in FIGS. 5A-5B and 7A-7B, the tray 206, 206' forms the base of each light module 202, 202'. A circuit board (e.g., a printed circuit board) 220, 220' is positioned upon the seat 212, 212', and extends at least a portion of the length of the seat 212, 212'. In some examples, the circuit board 220, 220' is centered along the longitudinal axis Y-Y of the tray 206, 206'. The circuit board 220, 220' can extend an entire length of the seat 212, 212', and can be secured to the seat 212, 212' using a combination of hooks 218 and fasteners 258. The inner set of hooks 218 can serve as both locating and securing features by extending partially over and resiliently engaging the circuit board 220, 220'. Fasteners 258 (e.g., bolts) can be passed through the circuit board 220, 220' and secured to the seat 212, 212' to removably couple the circuit board 220, 220' to the tray 206, 206'.

One or more solid state (e.g., LED, OLED, PLED, QLED) light sources 208, 208' are secured to the circuit board 220, 220' and are configured to provide illumination to an area outside the light modules 202, 202'. The solid state light sources 208, 208' can be spaced apart from one another on the circuit board 220, 220' and positioned at various points along the longitudinal axis Y-Y. In some embodiments, two series of LED light sources 208, 208' extend along the length of the circuit board 220, 220', approximately parallel to the longitudinal axis Y-Y. Power can be input to (or positioned onboard) the circuit board 220, 220', which can then be used to operate one or more of the LED light sources 208 positioned on the circuit board 220, 220'.

Although described as being positioned on and mounted to the seat 212, 212', different locations for the circuit board 220, 220' and light sources 208, 208' may be incorporated in embodiments of the disclosure. For example, circuit boards 220, 220' may be mounted to each leg 230, 232, and each light source 208 may be configured to direct light outward, in a direction approximately perpendicular to the longitudinal axis Y-Y. Alternatively, light sources 208 may direct light inward from a perimeter of the tray 206, 206' (e.g., to create an edge-lit effect).

The lens 210, 210' extends convexly across a portion of the seat 212, 212' to protect the solid state light sources 208, 208' positioned along the seat 212, 212' and to act as a diffuser for light emitted by the solid state light sources 208, 208'. In some examples, the lens 210, 210' is defined by a length approximately equal to the length of the seat 212, 212'. The lens 210, 210' is centered above the circuit board 220, 220' and centered along and surrounding the longitudinal axis Y-Y. The lens 210, 210' and seat 212, 212' together surround the circuit board 220, 220' and solid state light sources 208, 208', which shield the solid state light sources 208, 208' from unintentional and unwanted damage that may otherwise occur through contact. The lens 210, 210' can be secured by the hooks 216 formed along the outer perimeter of the seat 212, 212'. The resilient nature of the lens material (e.g., a polymeric material like acrylic or polycarbonate) allows the lens 210, 210' to bend into shape when the lens 210, 210' is engaged on each side by the hooks 216. To fully enclose the solid state light sources, hemispherical end caps 260 can be positioned on each end of the light module 202, 202', engaging both the lens 210, 210' and the seat 212, 212' of the tray 206, 206'.

To create the lighting fixtures 100, 100' shown in FIGS. 3A-4C and the retrofit assemblies 200, 200' used within the lighting fixtures 100, 100', the central hub 204, 204' is positioned between and coupled to two lighting fixtures 202, 202'. The central hub 204, 204' can straddle the longitudinal axes Y-Y of each lighting fixture 202, 202' (and the longitudinal axis X-X of the housing 102, 102') and can be coupled to the housing 102, 102' using fasteners. For example, the central hub 204, 204' can be configured to engage with the housing 102, 102' through slots or openings in the housing 102, 102' and/or via a suitable fastener (e.g., bolts, screws, rivets, etc.). In some embodiments, one or more bendable or repositionable tabs on the tray 206, 206' are configured to engage with the central hub 204, 204'. Alternatively, the trays 206, 206' (and lighting modules 202, 202', more generally) may be secured to the housing 102, 102' independent from the central hub 204, 204'.

The central hub 204, 204' is configured to receive a portion of two different light modules 202, 202'. A base 302, 302' of the central hub 204, 204' includes a first face 304, 304' (which can form a "first end" of the base 302, 302') formed on a first end 306, 306' of the central hub 204, 204' and a second face 308, 308' (which can form a "second end" of the base 302, 302') formed on a second end 310, 310' of central hub 204, 204', spaced apart from and opposite to the first end 306, 306'. The first face 304, 304' and the second face 308, 308' can be at least partially defined by a continuous, bell-shaped upper surface 312, 312' that extends from the first end 306, 306' to the second end 310, 310' of the base 302, 302'. The first face 304, 304' and the second face 308, 308' each define partially concave cavities 314, 314', 316, 316' formed inward from each of the ends 306, 306', 310, 310'. The cavities 314, 314', 316, 316' include a linear portion 318, 318' configured to extend parallel to and engage the legs 230, 232 of the tray 206, 206'. Concave arcs 320, 320' extend between the linear portion 318, 318' of the cavities 314, 314', 316, 316'. The concave arcs 320, 320' can be defined by a radius similar to the convex lens 210, 210', so that the concave arc 320, 320' is complimentary to lenses 210, 210'. The linear portions 318, 318' and the concave arcs 320, 320' provide the cavities 314, 314', 316, 316' with a partially concave shape that can each receive an end of a light module 202, 202' simultaneously. Cavity faces 322, 322', 324, 324' spaced inwardly apart from the first and second faces 304, 304', 308, 308' can act as locating features for each light module 202, 202'. When assembling a retrofit assembly 200, 200', each light module 202, 202' can be urged inward toward the central hub 204, 204' until the cavity faces 322, 322', 324, 324' are engaged.

The size and shape of the central hub 204, 204' can be varied to accommodate housings 102, 102' with different sizes and shapes. For example, the central hub 204 can be adapted for T5 housings 102 having a total length of about 92 inches. Accordingly, the central hub 204 can be defined by a thickness (e.g., distance measured from cavity face 322 to cavity face 324) of about 2 inches. The central hub 204' can be adapted for T8 housings 102' having a total length of about 96 inches. Because the same lighting modules 202, 202' are used to create each type of retrofit housing 200, 200', the central hubs 204, 204' are readily interchangeable to accommodate different housings 102, 102 to create different light fixtures 100, 100'. The amount of overhang (e.g., distance measured from the first end to the cavity face 322 and distance measured from the second end to the cavity face 324) on each central hub 204, 204' can vary, depending on the type and positioning of the solid state light sources 208, 208' on each light module 202, 202'. The central hub 204, 204' may be formed (e.g., bent, molded, or otherwise formed) from a single piece of material (e.g., metal, plastic, etc.). As shown in FIGS. 9A-10D, the central hub 204, 204' is molded (e.g., injection molded) from a polymeric material.

The central hub 204, 204' can be configured to support a sensor 326 (e.g., a motion sensor, an ambient light sensor, etc.). The sensor monitors an area outside the first lighting module and second lighting module for an indicator, such as ambient light or motion, and provides a signal to a controller or processor upon detecting that the indicator is present within the area. In some embodiments, the base 302, 302' includes a rectangular protrusion 328, 328' adapted to support the sensor 326 away from the bell-shaped surface 312, 312'. The sensor 326 can be placed in communication with a controller (not shown) positioned within a rectangular cavity 330, 330' formed behind the rectangular protrusion 328, 328', which receives information from the sensor 326 and provides an operating command to one or more of the light modules 202, 202' based upon the information received from the sensor 326.

With further reference to FIGS. 11A-11D, the formation of retrofit assemblies 200, 200' from a common kit 400 is described. The kit 400 includes two light modules 202, a central hub 204, and a central hub 204'. The difference in thickness between the central hub 204 and the central hub 204' and the interchangeability of each component allows the same two light modules 202 to create different retrofit assemblies 200, 200' that accommodate differently sized light fixtures (e.g., light fixtures with housings 102, 102' of different length in a longitudinal direction, etc.). The width of the central hub 204, 204' is varied to accommodate any additional space within the light fixture that is not occupied by the light modules 202. For example, the first central hub 204 may be used in a housing 102 that has a length (e.g., a dimension parallel to a central axis, a longitudinal dimension, etc.) of approximately 92 inches. The second central hub 204' may be used in a housing that has a length of approximately 96 inches. In this example, the second central hub 204' is larger than the first central hub 204. The sensor 326 type and dimensions may also vary with the central hub 204, 204' to prevent light from being blocked (e.g., covered, shielded, etc.) by the sensor 326.

The two light modules 202 within the kit 400 can have an identical length and width, but may vary in functionality. For example, one of the light modules 402 can be a master module, while the other light module 404 can be a satellite module in electrical communication with the master module 402. The master module 402 can include a power supply 406, a transformer 408, and a controller 410 configured to receive power from the power supply 406 and issue a command to selectively activate solid state light sources 208. In some embodiments, the power supply 406 is mounted to the circuit board 220. The controller 410 can be included within the driver 236, for example, which is mounted to the seat 212 of the tray 206. In some embodiments, the controller 410 and/or driver 236 are placed in communication with the sensor 326 or the controller coupled to the sensor 326, and command the solid state light sources 208 to operate based upon a signal received from either the sensor 326 or the controller.

The satellite module 404 can be placed in electrical communication with the master module 402 (e.g., hardwired or otherwise in wireless communication). The satellite module 404 can receive operating commands from the master module 402. For example, the controller 410 can be used to provide instructions to both the master module 402 and the satellite module 404 simultaneously. The satellite module 404 can also include its own on-board power supply 412 and transformer 414, which can be used to power the solid state light source present on the satellite module 404. In some embodiments, an external power source (e.g., a wall source) is used to provide power to each of the master module 402, satellite module 404, and the sensor 326.

The kit 400 can create two differently-sized retrofit assemblies 200, 200', which can then be used to create two differently-sized light fixtures 100, 100'. A first retrofit assembly 200 is created when the central hub 204 is positioned between the two light modules 202. When assembled, the longitudinal axes Y-Y of each light module 202 and the longitudinal axis X-X are collinear. Similarly, the seats 212 of each tray 206 extend coplanar with one another. The second retrofit assembly 200' having a different length than the first retrofit assembly 200 is created by interchanging the central hub 204 with the central hub 204'. The difference in thicknesses between the central hubs 204, 204' creates a difference in total length of the retrofit assemblies 200, 200' as well, enabling differently-sized and shaped housings 102, 102' to be retrofit with the same kit 400.

While the retrofit assembly is primarily illustrated coupled to a commercial lighting fixture, it is to be understood that the retrofit assembly may be suitable for residential, outdoor (e.g., area lighting, etc.), and/or industrial lighting (e.g., high bay lighting applications, etc.) as well. It is understood that the particular dimensions supplied herein are only for illustrative purposes; light fixture 100 and the retrofit assembly may have any shape, size, and/or configuration tailored for a target application. Additionally, use of the term "LED" throughout the disclosure, unless indicated otherwise, refers to and is intended to include all solid state lighting sources, including LED, QLED, OLED, and PLED lights and/or light sources.

The construction and arrangement of the apparatus, systems, and methods as shown in the various exemplary embodiments are illustrative only. Although only a few embodiments have been described in detail in this disclosure, many modifications are possible (e.g., variations in sizes, dimensions, structures, shapes, and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method blocks may be varied or re-sequenced according to alternative embodiments. Other substitutions, modifications, changes, and omissions may be made in the design, operating conditions, and arrangement of the exemplary embodiments without departing from the scope of the present disclosure.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary," as used herein to describe various embodiments, is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

What is claimed is:

1. A retrofit assembly for a lighting fixture, the retrofit assembly comprising:

a first lighting module including:

a first tray defining a first longitudinal axis and having a first seat and a first set of legs extending away from the first seat;

a first solid state light source coupled to the first seat; and a first lens, the first lens and first seat at least partially surrounding the first solid state light source;

a second lighting module including:

a second tray defining a second longitudinal axis and having a second seat and a second set of legs extending away from second seat;

a second solid state light source coupled to the second seat; and a second lens, the second lens and second seat at least partially surrounding the second solid state light source; and a hub positioned between the first lighting module and the second lighting module, the hub being defined by a base having a first end and a second end spaced apart from the first end, wherein a first cavity is formed within the base inward from the first end and a second cavity is formed within the base inward from the second end, the first cavity receiving a portion of the first lighting module and the second cavity receiving a portion of the second lighting module to align the first longitudinal axis and the second longitudinal axis in an approximately parallel relationship.

2. The retrofit assembly of claim 1, wherein the first lighting module includes an onboard power supply, the power supply being configured to provide electrical power to each of the first lighting module and the second lighting module.

3. The retrofit assembly of claim 1, further comprising a sensor coupled to the hub and configured to monitor an area outside the retrofit assembly for an indicator.

4. The retrofit assembly of claim 1, wherein the first lighting module includes a first set of retaining features and a second set of retaining features, the first set of retaining features being engaged and the second set of retaining features being disengaged when the retrofit assembly is positioned within a housing defined by a first length and the first set of retaining features being disengaged and the second set of retaining features being engaged when the retrofit assembly is positioned within a housing defined by a second length longer than the first length.

5. The retrofit assembly of claim 4, wherein the retaining features within the first set of retaining features and the retaining features within the second set of retaining features are chosen from the group consisting of mounting holes, notches, protrusions, indents, clips, and screws.

6. The retrofit assembly of claim 1, wherein the first lens arcs away from two spaced apart locations on the first seat to create a convex shape defined by a first radius.

7. The retrofit assembly of claim 6, wherein a portion of the first cavity is defined by a second radius larger than the first radius such that a portion of the first lens can be received within the first cavity.

8. The retrofit assembly of claim 6, wherein a portion of the hub overhangs and surrounds a portion of the first lens.

9. The retrofit assembly of claim 6, wherein the second lens arcs away from two spaced apart locations on the second seat to create a convex shape defined by a third radius approximately equal in size to the first radius.

10. The retrofit assembly of claim 9, wherein a portion of the second cavity is defined by a fourth radius approximately equal in size to the second radius such that a portion of the second lens can be received within the second cavity.

11. A retrofit assembly for a lighting fixture, the retrofit assembly comprising:

a master lighting module including:

a first tray defining a first longitudinal axis and having a first seat and a first set of legs extending away from the first seat;

a power supply and controller coupled to the first tray;

a first solid state light source coupled to the first tray, electrically coupled to the power supply, and selectively actuated by the controller; and a first lens removably coupled to the first seat and extending around at least a portion of the first solid state light source;

a slave lighting module including:

a second tray defining a second longitudinal axis and having a second seat and a second set of legs extending away from the second seat; and a second solid state light source coupled to the second tray, electrically coupled to the power supply, and selectively actuated by the controller; and a second lens removably coupled to the second seat and extending around at least a portion of the second solid state light source; and a hub positioned between the master lighting module and the slave lighting module to align the first longitudinal axis and the second longitudinal axis in an approximately parallel relationship.

12. The retrofit assembly of claim 11, wherein the hub defines cavities formed within opposite sides of the hub, the cavities each receiving and surrounding at least a portion of one of the master lighting module and the slave lighting module.

13. The retrofit assembly of claim 11, further comprising a sensor supported by the hub and in communication with the controller, the sensor being configured to detect an indicator and, in response to detecting the indicator, alert the controller that the indicator has been detected.

14. The retrofit assembly of claim 11, wherein the first longitudinal axis and the second longitudinal axis extend coaxially.

15. The retrofit assembly of claim 11, wherein the first solid state light source and the controller are positioned on opposite sides of the first seat.

16. The retrofit assembly of claim 11, wherein the first lens is removably coupled to the first seat with hooks extending upward from the first seat.

17. A retrofit assembly for a lighting fixture, the retrofit assembly comprising:

a first lighting module including:

a first tray having a first seat and a first set of legs extending away from the first seat to collectively define a first wire channel between the first seat and the first set of legs; and a first solid state light source coupled to the first seat and positioned outside the first wire channel;

a second lighting module including:

a second tray having a second seat and a second set of legs extending away from the second seat to collectively define a second wire channel between the second seat and the second set of legs; and a second solid state light source coupled to the second seat and positioned outside the second wire channel;

a hub having a base defining a first cavity and a second cavity on opposite sides thereof, the first cavity receiving a portion of the first lighting module and the second cavity receiving a portion of the second lighting module, and wherein a wire passage is formed within and through the base between the first cavity and the second cavity, such that the first wire channel, the wire passage, the second wire channel form a continuous wireway.

18. The retrofit assembly of claim 17, wherein the wire passage is defined by a passage width and a passage depth, the passage width being less than a width of the first wire channel and the passage depth being less than a depth of the first wire channel.

19. The retrofit assembly of claim 17, wherein a window is formed through the first seat to create a wire pathway between the first wire channel and the first solid state light source.

20. The retrofit assembly of 17, wherein the first cavity is defined by a generally semi-cylindrical shape formed by two linear walls and a concave arc extending between the two linear walls, the linear walls each being arranged parallel to the first set of legs.

* * * * *